United States Patent [19]

Järvinen

[11] Patent Number: 4,627,108

[45] Date of Patent: Dec. 9, 1986

[54] KNEE AND SHIN PROTECTOR

[75] Inventor: Jyrki H. Järvinen, Vaasa, Finland

[73] Assignee: Yoko-team Oy, Forssa, Finland

[21] Appl. No.: 673,949

[22] Filed: Nov. 21, 1984

[30] Foreign Application Priority Data

Dec. 29, 1983 [FI] Finland ..... 834838

[51] Int. Cl.[4] ..... A41D 13/00

[52] U.S. Cl. ..... 2/22; 2/24

[58] Field of Search ..... 2/22, 24; 24/350

[56] References Cited

U.S. PATENT DOCUMENTS

| | | | |
|---|---|---|---|
| 728,414 | 5/1903 | Rhoads | 24/350 |
| 902,407 | 10/1908 | Humphrey | 24/350 X |
| 924,355 | 6/1909 | Howard | 24/350 X |
| 1,913,864 | 6/1933 | Walper | 24/350 X |
| 1,970,130 | 8/1934 | Dickenson | 2/2 |
| 2,663,061 | 12/1953 | Zarth | 24/350 |
| 4,467,475 | 8/1984 | Gregory | 2/2 |
| 4,484,360 | 11/1984 | Leighton et al. | 2/24 |

FOREIGN PATENT DOCUMENTS

| | | | |
|---|---|---|---|
| 967302 | 5/1975 | Canada | 2/22 |
| 1129430 | 5/1962 | Fed. Rep. of Germany | 2/24 |
| 2710430 | 9/1978 | Fed. Rep. of Germany | 2/24 |
| 1562191 | 3/1980 | United Kingdom | 2/22 |

*Primary Examiner*—Louis K. Rimrodt

*Attorney, Agent, or Firm*—Owen, Wickersham & Erickson

[57] ABSTRACT

The invention relates to a knee and shin protector, comprising an outer shield (1, 3) and a separate padding layer (2) fitted therein. The outer shield consists of a shin guard (1) and a separate knee cap (3), both of said guards (1, 3) being fastened to the padding layer (2).

2 Claims, 4 Drawing Figures

KNEE AND SHIN PROTECTOR

The present invention relates to a knee and shin protector, comprising an outer shield and a separate padding layer fitted inside the shield.

In knee and shin protectors used in various sport activities and of course for other applications as well, the protector comprises a relatively hard outer layer and a padding layer fitted therein. In order to provide as effective a protection as possible it is important that the size of a protector be dimensioned as accurately as possible according to a user. This naturally means that protectors must be manufactured in various size ranges. Since the protectors in question, particularly the outer shields thereof, are moulded in plastics, it is necessary to manufacture a separate mould for each size range. This is inconvenient and uneconomical.

An object of the invention is to provide a new type of protector which is economical in terms of manufacturing and whose size or length can be changed by using the same outer shield elements regardless of the size.

A protector according to the invention is characterized in that the outer shield comprises a shin guard and a separate knee guard, both of said guards being attached to the padding layer, and in a preferred embodiment said guards are fitted with fastening lugs and the padding layer with fastening means fitting in with the lugs. The fastening means can be e.g. notches, catches, links or the like.

In an alternative embodiment, the guards can be fastened to the padding layer by means of a sticker joint or the like. Since, in a protector of the invention, the knee guard and shin guard are separate elements, they can be fastened to a common padding layer in a manner that, according to the size of a user, the knee guard will settle in a suitable position relative to the shin guard.

Figure 1:
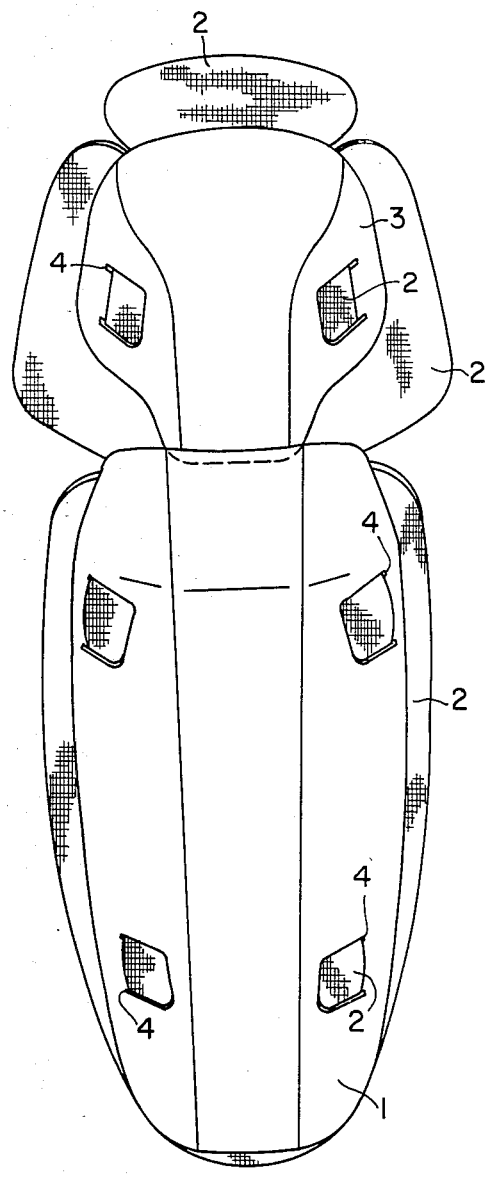
Figure 2:
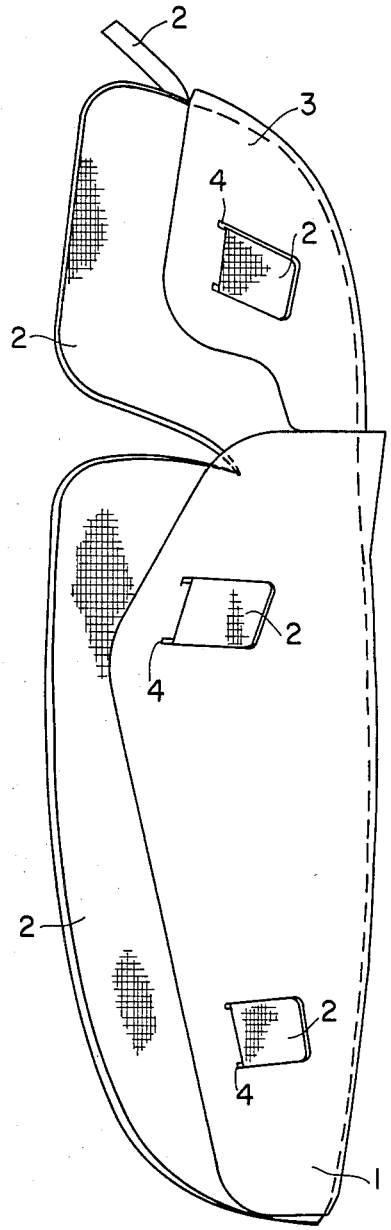
Figure 3:
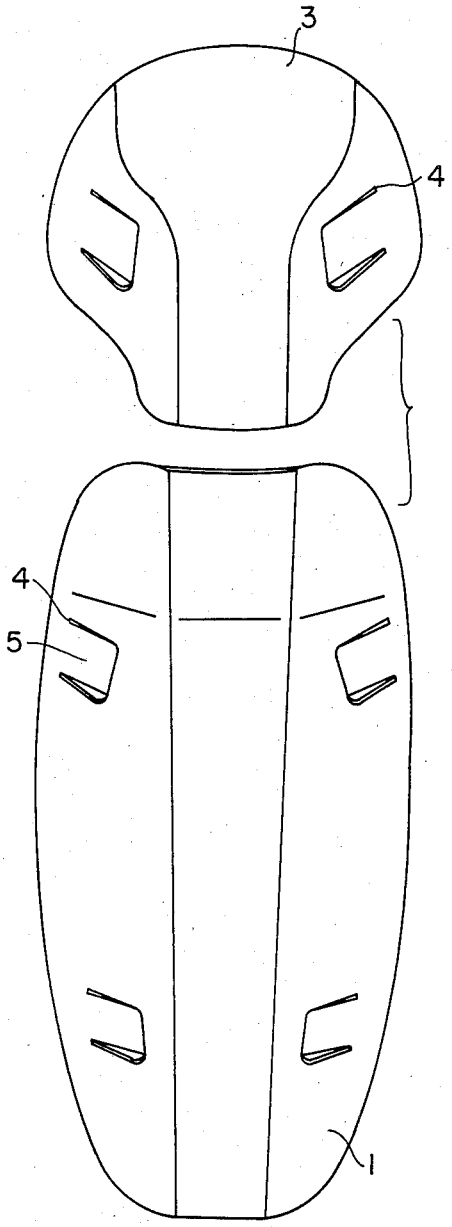
Figure 4:
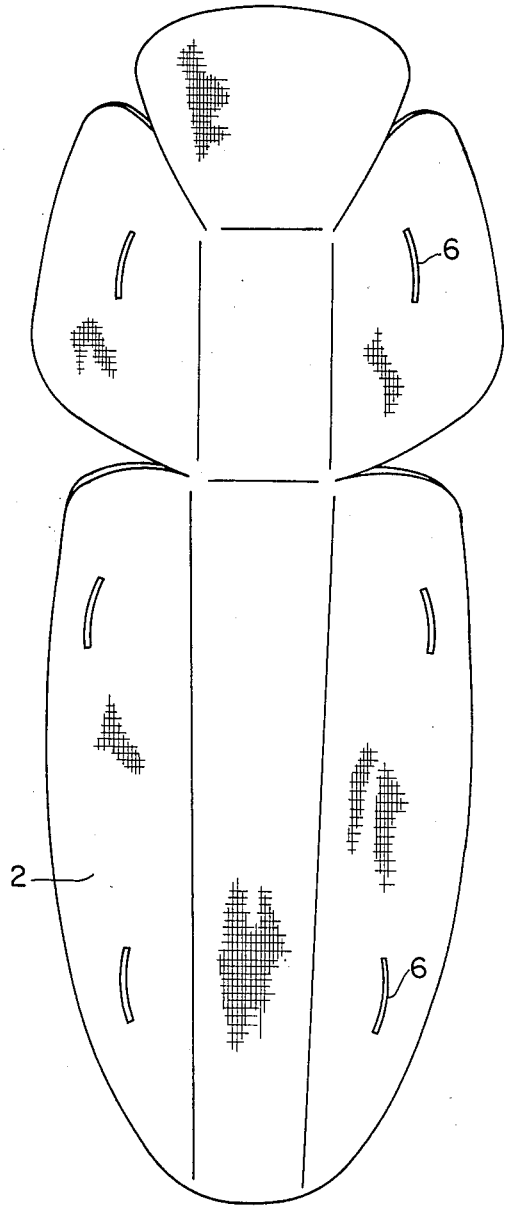

The invention will now be described in more detail with reference made to the accompanying drawings, in which FIG. 1 is a front view of a protector of the invention, FIG. 2 is a side view of the protector of FIG. 1, and FIGS. 3 and 4 show the separate elements of the protector of FIG. 1.

A protector of the invention consists of two outer shields or guards, the lower comprising a shin guard 1 which is an elongated gutter-shaped element. Above it is a smaller cap-like knee guard 3 which is an element separate from shin guard 1. Fitted inside these two outer guards 1, 3 is a common padding layer 2 which in the presently shown case has been dimensioned larger than the outer shields for a protection as effective and extensive as possible. Thus, the separate outer shield elements 1 and 3 are attached to the common padding layer 2 by means of fastening members. In the application shown in the figure, said fastening elements comprise lugs 5, provided by cut-outs 4 made in knee cap 3 and shin guard 1. For fastening said shields 1, 3 to the padding layer, said layer is provided with notches 6 aligned with lugs 5 (FIG. 4). These notches 6 are disposed in a manner that said shields 1 and 2 build up a complete protector in a certain size range. Thus, in this type of application, notches 6 are already made at the manufacturing stage in the padding layer. Of course, it is also possible for a user himself to make notches 6 in the padding layer in desired positions for coming up with a protector of desired size.

The protector is assembled by inserting lugs 5 of said outer shields 1, 3 in notches 6 for fastening the shields to the padding and setting them in proper positions relative to each other.

In the figures, the shields are fastened to the padding layer by means of lugs and notches. It is naturally possible to use other fastening elements as well, said notches being replaced by catches, links or the like fitting in with the lugs. Of course, it is also possible to use various sticker joints or adhesive joints. What is essential is that a shin guard and knee cap 3 can be fastened to the padding at desired points, whereby the size of a protector can be adjusted by still using the same components. Hence, it is possible to manufacture protectors of varying sizes from equal-sized knee and shin guards, fastened to a common padding layer. This padding layer comprises a padding layer, preferably a layer of cellular plastics, cut out of a single element. Designing and shaping of such a layer is simple and it can include plies of various sizes, especially various lengths. On the other hand, the knee and shin guards 1, 2 are only needed in a single or a few sizes, which can be used to produce a plurality of protectors of varying sizes.

I claim:

1. A knee and shin protector providing a two-piece outer shield and a separate padding layer fitted in, and serving to join said two-piece shield together, comprising a molded plastic shin guard comprising one piece of said outer shield, a separate molded plastic knee guard comprising the second piece of said outer shield, each piece of said shield being defined by outer edges and having a plurality of integral lugs spaced away from outer edges of said shield and defined by cut-out portions leaving only an integral attachment portion, and a single padding member larger in area than the total area of said outer shield and having a plurality of notches, each receiving one of said lugs therethrough, so that said single padding member is united to said two shield pieces by said lugs and notches.

2. A knee and shin protector providing a two-piece outer shield and a separate padding layer fitted in, and serving to join said two-piece shield together, comprising a molded plastic shin guard constituting one piece of said outer shield, a separate molded plastic knee guard constituting a second piece of said outer shield, each piece of said shield being defined by outer edges and having a central portion and two side portions on opposite sides of said central portion, said shield having integral generally rectangular lugs in each said side portion spaced away from outer edges of said shield and defined by a cut-out portion along three sides thereof and an integral attachment portion along the other side thereof, and a single padding member larger in area than the total area of said outer shield and having a plurality of notches therethrough, each receiving one of said lugs therethrough, so that said single padding member is united to said two shield pieces by said lugs and notches.

* * * * *